US006712620B1

(12) United States Patent
Li et al.

(10) Patent No.: US 6,712,620 B1
(45) Date of Patent: Mar. 30, 2004

(54) COAXIAL ELASTOMERIC CONNECTOR SYSTEM

(75) Inventors: Che-Yu Li, Ithica, NY (US); Zhineng Fan, Sunnyvale, CA (US); Dirk D. Brown, Mountain View, CA (US)

(73) Assignee: High Connection Density, Inc., Sunnyvale, CA (US)

( * ) Notice: Subject to any disclaimer, the term of this patent is extended or adjusted under 35 U.S.C. 154(b) by 0 days.

(21) Appl. No.: 10/241,945

(22) Filed: Sep. 12, 2002

(51) Int. Cl.[7] ..... H01R 12/00

(52) U.S. Cl. ..... 439/63; 439/67; 439/77; 439/394

(58) Field of Search ..... 439/63, 67, 77, 439/578, 581, 394

(56) References Cited

U.S. PATENT DOCUMENTS 3,715,706 A * 2/1973 Michel et al. ..... 439/493
5,236,366 A * 8/1993 Deak et al. ..... 439/67
5,494,454 A 2/1996 Johnsen ..... 439/394
5,509,827 A 4/1996 Huppenthal et al. ..... 439/638
5,823,795 A * 10/1998 Schumacher ..... 439/76.1
6,264,476 B1 7/2001 Li et al. ..... 439/66
6,280,201 B1 * 8/2001 Morris ..... 439/65
6,545,220 B2 * 4/2003 Syed et al. ..... 174/75 C

* cited by examiner

*Primary Examiner*—Dean A. Reichard
*Assistant Examiner*—Jinhee Lee
(74) *Attorney, Agent, or Firm*—Duane Morris LLP

(57) ABSTRACT

A board-to-board connector system is provided that may be used with a flex circuit, interposer, or polymer housing that includes a plurality of contacts that are arranged in an array. Each of the plurality of contacts includes a resilient body. A first conductor is provided that includes at least one wire formed in a spiral extending continuously through the resilient body, and having electrically accessible first and second ends. The first conductor is electrically connected to at least one of a plurality of signal conductor traces on a printed wiring board or the like. A second conductor is provided that includes at least one wire formed in a spiral extending continuously through the resilient body, and having electrically accessible first and second ends. The first conductor and the second conductor are in spaced apart relation to one another, and the second conductor is electrically connected to at least one of the plurality of ground path conductors arranged on the printed wiring board.

34 Claims, 13 Drawing Sheets

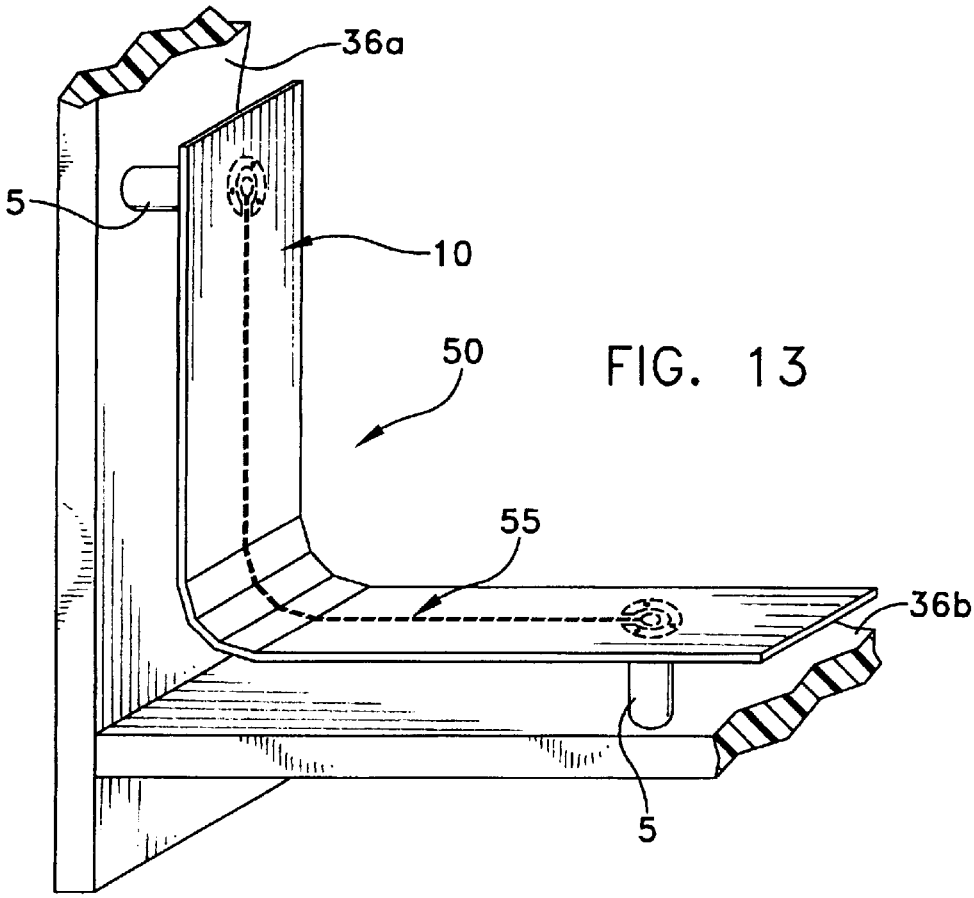
FIG. 13
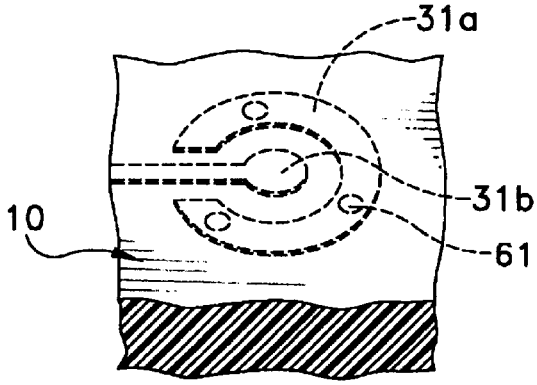
FIG. 14
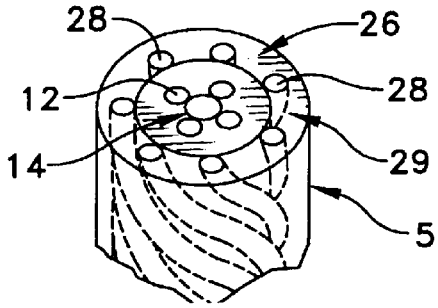

COAXIAL ELASTOMERIC CONNECTOR SYSTEM

FIELD OF THE INVENTION

The present invention generally relates to interconnection systems for high speed electronics systems, and more particularly to a shielded elastomeric contact adapted for use in several different connector systems that are capable of high speed data transmission.

BACKGROUND OF THE INVENTION

Electrical connectors that are mounted to a printed circuit board are well known in the art. As the size of the electronic devices in which the printed circuit boards are installed has decreased, the density of the connectors positioned on those boards has increased. Such electronic devices also require electrical connectors, with numerous terminals to be mounted on a printed circuit board in such a manner as to occupy a minimal area of printed circuit board real estate, while at the same time capable of transmitting ever higher data rates.

In order to provide for a higher density of connectors on printed circuit boards, surface mount technology was utilized. With surface mounting, the conductive pads on the printed circuit board can be closely spaced, thereby allowing more contacts to be mounted in the same area of the board. As the density of the connectors on the printed circuit board increases, the length of the terminals cannot increase significantly without degrading the electrical performance of the electronic device. This is particularly true in electronic devices designed for high speed applications. Typically, high density connectors, which have the shortest path over which the signals must travel, operate optimally. As the density of interconnects increases, and the pitch between contacts approaches 0.5 mm or less, the close proximity of the terminal contacts increases the likelihood of strong electrical cross-talk coupling between the terminal contacts. In addition, maintaining design control over the characteristic impedance of the terminal contacts becomes increasingly difficult.

The design control difficulties associated with maintaining the characteristic impedance within the necessary limits for optimum high speed data transfer are compounded when such high speed signals must be transmitted between spaced apart systems. Most often, coaxial-type cables and connectors are employed for such data transmission applications. Coaxial cable typically comprises a center conductor that is surrounded by overlapping layers of insulator material and electrical shielding material that extend the length of the transmission line. Coaxial connectors often have a circular center contact, a hollow cylindrical outer contact, and a tubular insulation between them. Such coaxial connectors are interconnected to coaxial cable by electrically and mechanically engaging the center conductor to the center contact and the shielding material to the hollow cylindrical outer contact. Retention features generally must be attached to the outside of the outer contact, since their insertion into slots in the insulation would result in a sudden change in impedance there, resulting in reflectance of signals and consequent increase in the VSWR (voltage standing wave ratio) and signal losses. Each coaxial type connector has a defined characteristic impedance with 50 ohms being the most common, and with losses increasing with deviations from the defined characteristic impedance at locations in the connector.

The traditional cylindrical shapes used in these types of connector systems often require relatively expensive manufacturing methods, such as machining of the inner contact, to form the coax connector assembly. Such assemblies are normally to large to be of any practical use in a printed wiring board to printed wiring board application. A coaxial-type contact assembly, or connector, with inner and outer contacts separated by insulation, for carrying signals in the range of megahertz and gigahertz, which could be constructed at low cost in a board-to-board configuration would be of significant value.

Modern electronics requires the use of high frequency and high speed connectors particularly for use in interconnecting circuitry on motherboards or backplanes and daughter cards or other circuit devices. These connectors have often times required shielding or ground planes between the signal pins; e.g., stripline configuration, to provide high frequency signal integrity and minimize interference from outside sources.

For example, U.S. Pat. No. 6,264,476 discloses an interposer for a land grid array that includes a dielectric grid having an array of holes and a resilient, conductive button disposed in one or more of the holes. The button includes an insulating core, a conducting element wound around the insulating core, and an outer shell surrounding the conducting element. The characteristics of the conducting element and the buttons may be chosen such that the contact force, contact resistance, and compressibility or relaxability of the conductive buttons can be selected within wide limits. The interposer design utilizing such conductive buttons is quite compatible with high data rate, high frequency and high current applications.

For some applications, however, it is desirable to have a highly dense array or grid of contact members, while maintaining the integrity between the lines, in a board-to-board configuration. As the center line spacing between contact members in a row is decreased, the spacing between adjacent columns of contact members is likewise decreased, thereby necessarily reducing the amount of dielectric housing material between the members of the array. This, in turn, affects the electrical characteristics of the connector system, and in particular reduces the impedance through the connector system. It is desirable, therefore, to have an electrical connector that provides a dense array of contact members, with the impedance characteristics often only found in coaxial connector systems, and arranged in a board-to-board connector system, while maintaining the electrical characteristics associated with connectors having a less dense array of contact members.

Though there are many types of connectors available, it would be desirable to have a connector with a precisely controlled impedance to reduce signal reflections. It would also be desirable to have a connector which could accommodate fast signals, those with rise times on the order of 250 psec or less. Such a connector should also be durable while at the same time being detachable so that printed circuit printed wiring boards can be joined and separated during use.

SUMMARY OF THE INVENTION

In one preferred embodiment of the invention, a flex circuit board-to-board connector system is provided that includes a flex circuit having a plurality of signal conductor traces and a plurality of ground path conductors. A plurality of contacts are arranged in an array on an outer surface of the flex circuit. Each of the plurality of contacts comprises a resilient body having a first end and a second end. A first conductor is provided that includes at least one wire formed in a spiral extending continuously through the resilient body from the first end to the second end, and having electrically accessible first and second ends. The first conductor is electrically connected to at least one of the plurality of signal conductor traces A second conductor is provided that includes at least one wire formed in a spiral extending continuously through the resilient body from the first end to the second end, and having electrically accessible first and second ends. The first conductor and the second conductor are in spaced apart relation to one another, and the second conductor is electrically connected to at least one of the plurality of ground path conductors.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts and further wherein:

FIG. 13 is a is a perspective view of a flex circuit connector system formed in accordance with the present invention;

FIG. 14 is a partially broken away, perspective view of a contact formed in accordance with the present invention arranged just prior to engagement with a contact pad on a flex circuit;

DETAILED DESCRIPTION OF THE PREFERRED EMBODIMENTS

Figure 1:
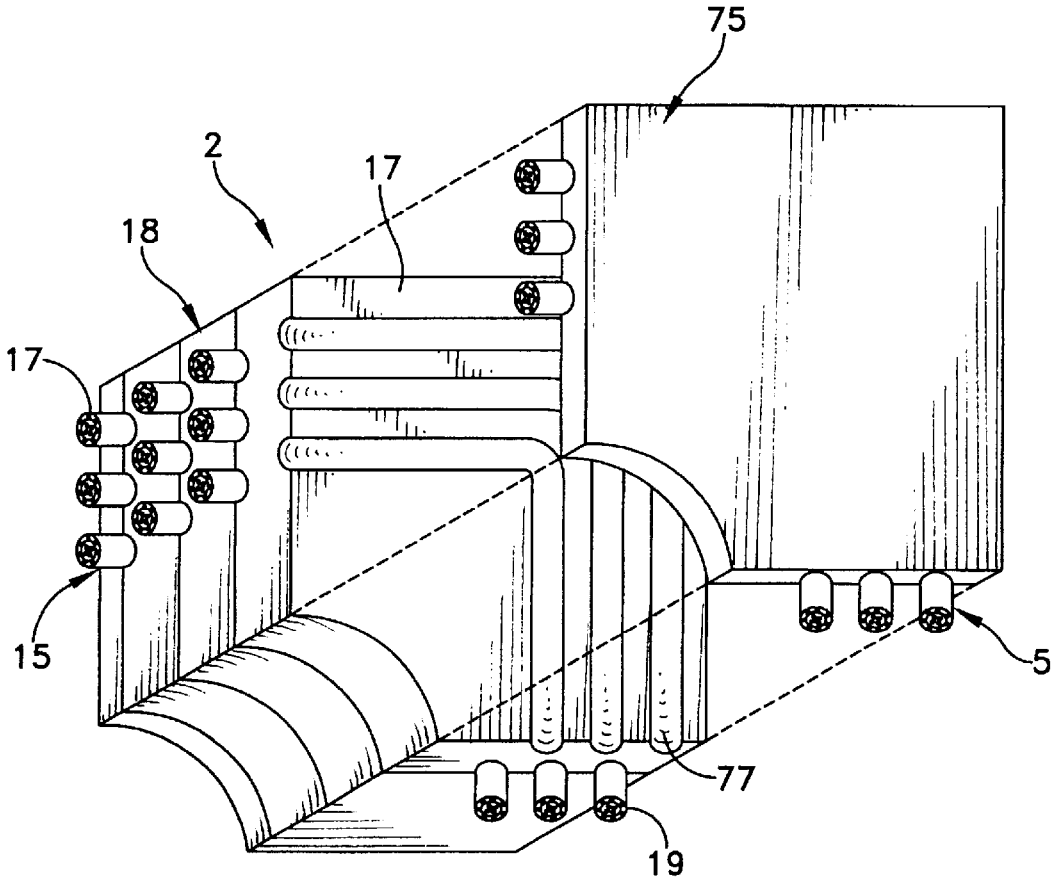
FIG. 1 is a partially exploded, perspective view of a coaxial elastomeric connector system formed in accordance with the present invention.

This description of preferred embodiments is intended to be read in connection with the accompanying drawings, which are to be considered part of the entire written description of this invention. The drawing figures are not necessarily to scale and certain features of the invention may be shown exaggerated in scale or in somewhat schematic form in the interest of clarity and conciseness. In the description, relative terms such as "horizontal," "vertical," "up," "down," "top" and "bottom" as well as derivatives thereof (e.g., "horizontally," "downwardly," "upwardly," etc.) should be construed to refer to the orientation as then described or as shown in the drawing figure under discussion. These relative terms are for convenience of description and normally are not intended to require a particular orientation. Terms including "inwardly" versus "outwardly," "longitudinal" versus "lateral" and the like are to be interpreted relative to one another or relative to an axis of elongation, or an axis or center of rotation, as appropriate. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise. The term "operatively connected" is such an attachment, coupling or connection that allows the pertinent structures to operate as intended by virtue of that relationship. In the claims, means-plus-function clauses are intended to cover the structures described, suggested, or rendered obvious by the written description or drawings for performing the recited function, including not only structural equivalents but also equivalent structures.

Figure 2:
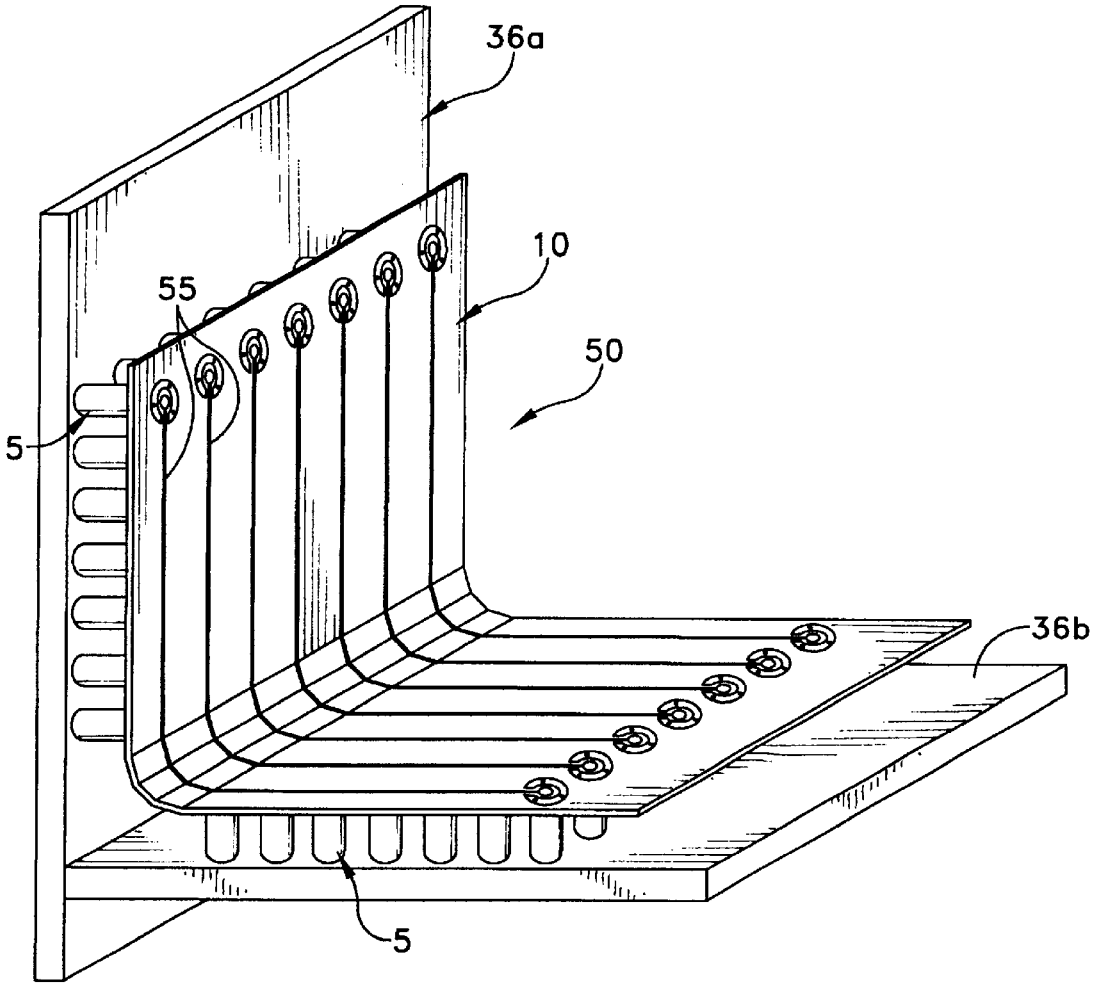
FIG. 2 is a perspective view of a flex circuit base connector system formed in accordance with the present invention.
Figure 3:
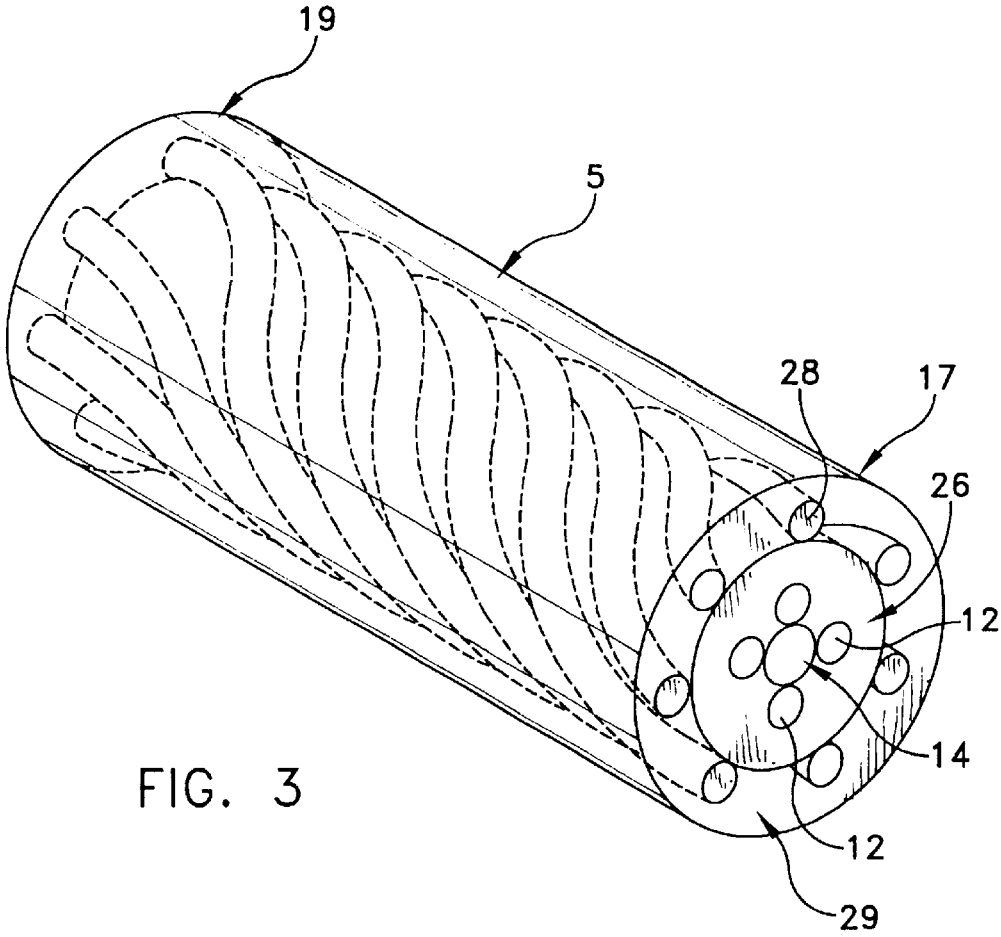
FIG. 3 is a perspective view, partially in phantom, of a compressible contact formed in accordance with the present invention.
Figure 4:
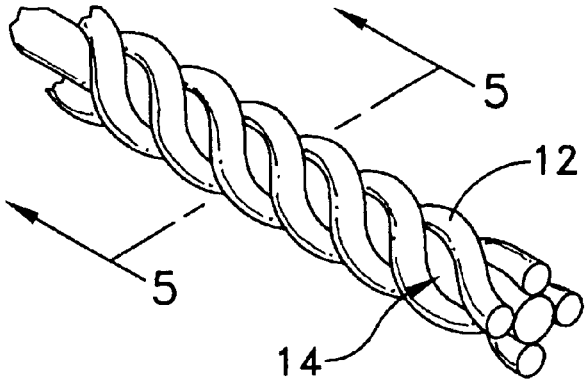
FIG. 4 is a perspective view of a plurality of flexible connecting elements wound around a compressible insulating core.

Referring to FIGS. 1 and 2, connector system 2 formed in accordance with the present invention comprises a plurality of elastomeric contacts 5 assembled within a housing block 18, or to portions of a flex circuit 10. More particularly, each elastomeric contact 5 comprises at least one flexible conducting element 12 wound around a compressible insulating core 14 extending from first end 17 to second end 19 of contact 5 (FIGS. 3–4). Suitable materials for flexible conducting elements 12 include gold, copper, and other metals or metal alloys of low specific resistivity. Non-noble metals can be plated or coated with a barrier metal covered with a surface structure of gold or other noble metals to ensure chemical inertness and provide suitable asperity distribution to facilitate good metal-to-metal contact.

Figure 5:
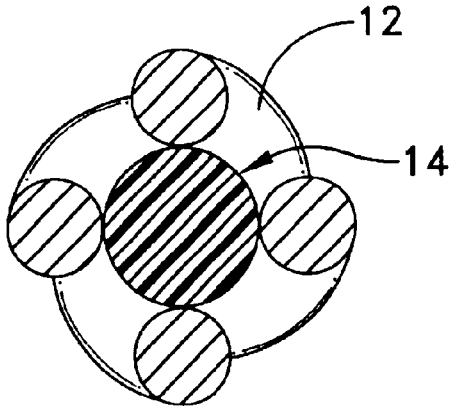
FIG. 5 is a cross-sectional view of a compressible insulating core having a plurality of flexible conducting elements wrapped around it, as taken along the lines 55 in FIG. 4.
Figure 6:
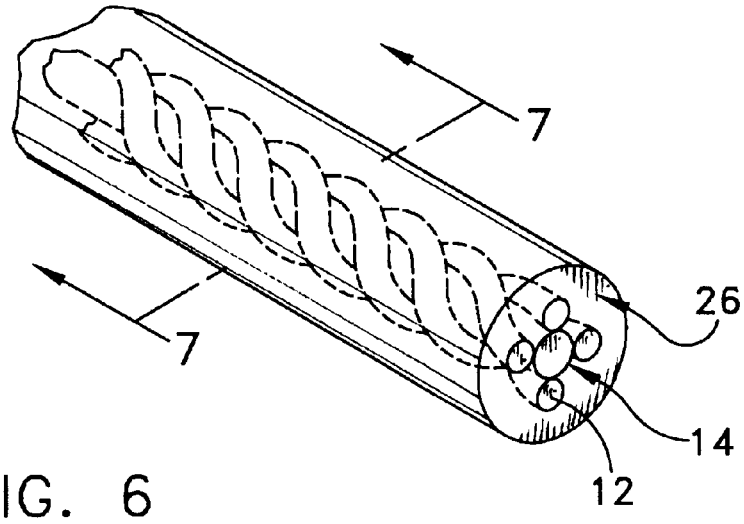
FIG. 6 is a perspective view similar to that shown in FIG. 4, but including a compressible outer shell 26.
Figure 7:
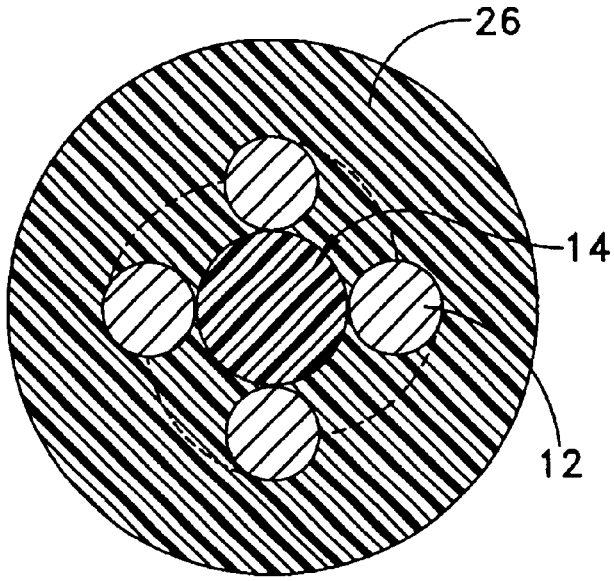
FIG. 7 is a cross sectional view of a compressible insulating core having a plurality of flexible conducting elements wrapped around it, and encased within a compressible outer shell, as taken along lines 77 in FIG. 6.
Figure 8:
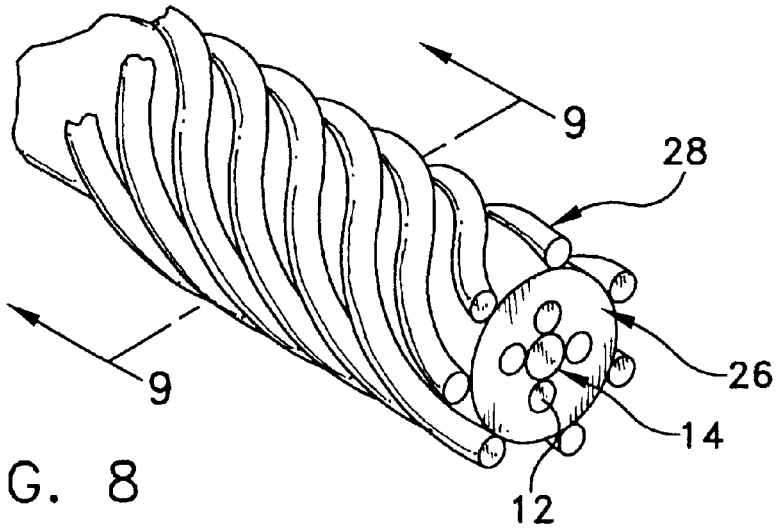
FIG. 8 is a perspective view of a plurality flexible conducting elements wrapped around a compressible insulating core, encased within a compressible outer shell 6 and further shielded by shielding layer.
Figure 9:
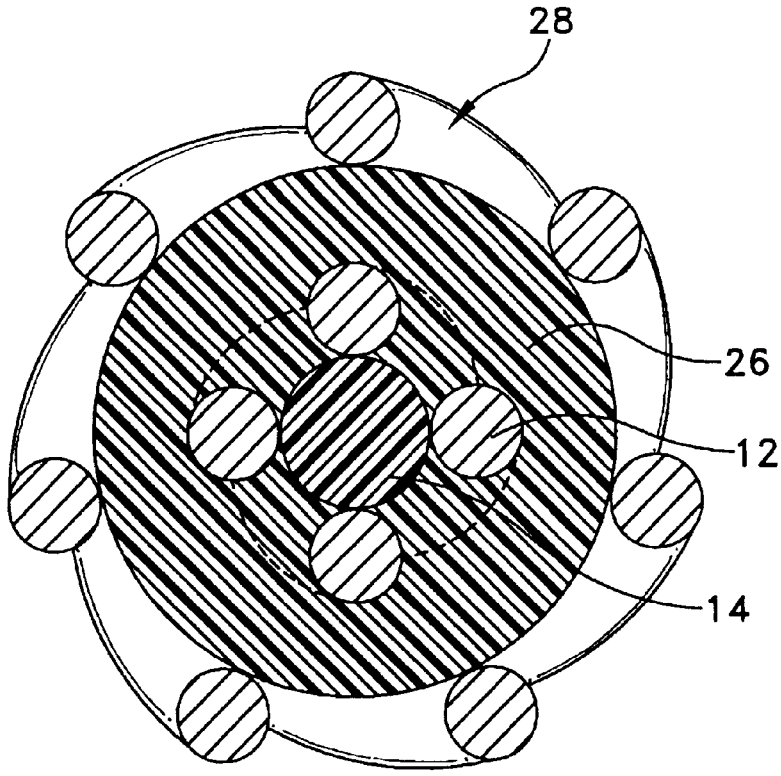
FIG. 9 is a cross-sectional view of FIG. 8 as taken along lines 99 in FIG. 8.
Figure 10:
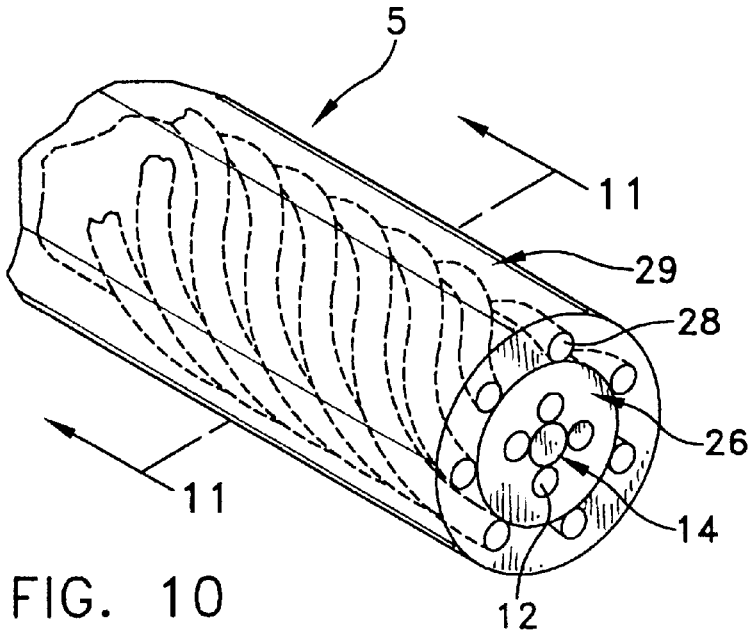
FIG. 10 is a perspective view similar to FIG. 8, but including an additional shielding layer.

Compressible insulating core 14 can comprise an insulating yarn or other suitable dielectric material (FIG. 5). A compressible, insulating outer shell 26 is arranged in surrounding relation to flexible conducting elements 12, and periodically engages portions of flexible conducting elements 12 and compressible insulating core 14 (FIGS. 3, 6 and 7). Flexible conducting elements 12 and compressible insulating core 14 are embedded in compressible outer shell 26 which is preferably formed from one of the well known elastomeric polymers, e.g., silicone rubber, neoprene, polybutadiene, or similar polymeric materials. In this way, the shell-to-conducting element engaging portions are along substantially the entire surfaces of each of flexible conducting elements 12.

Figure 11:
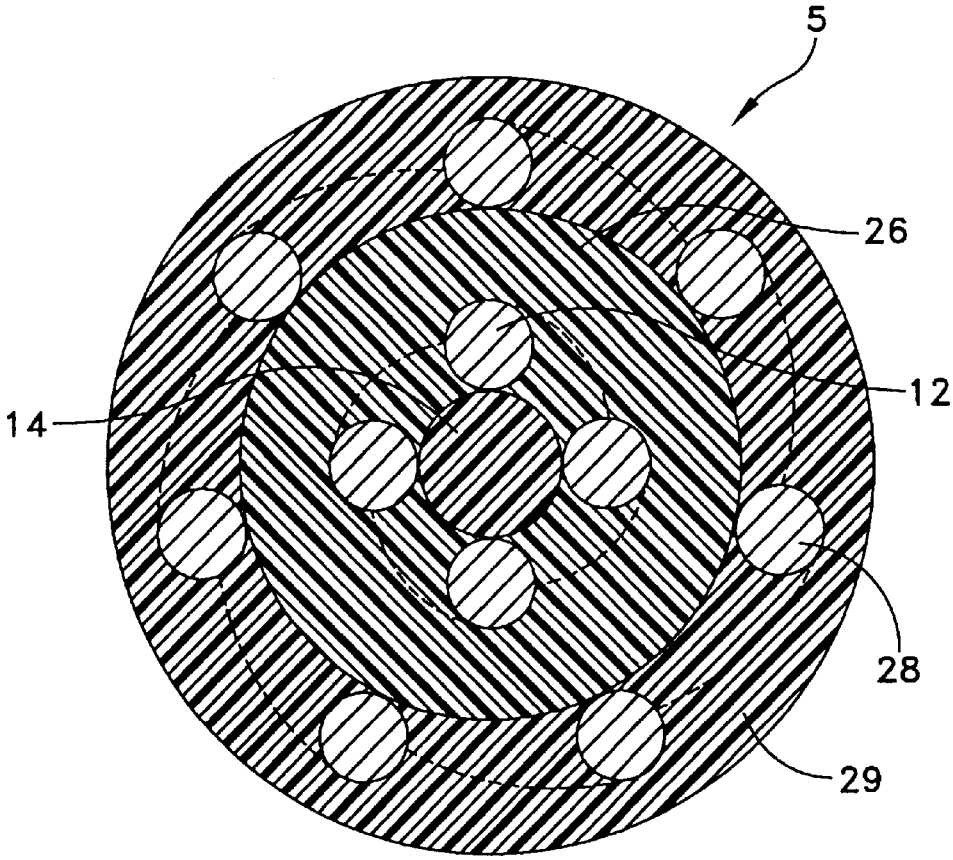
FIG. 11 is a cross-sectional view of FIG. 10 as taken along the lines 11 in FIG. 10.
Figure 12:
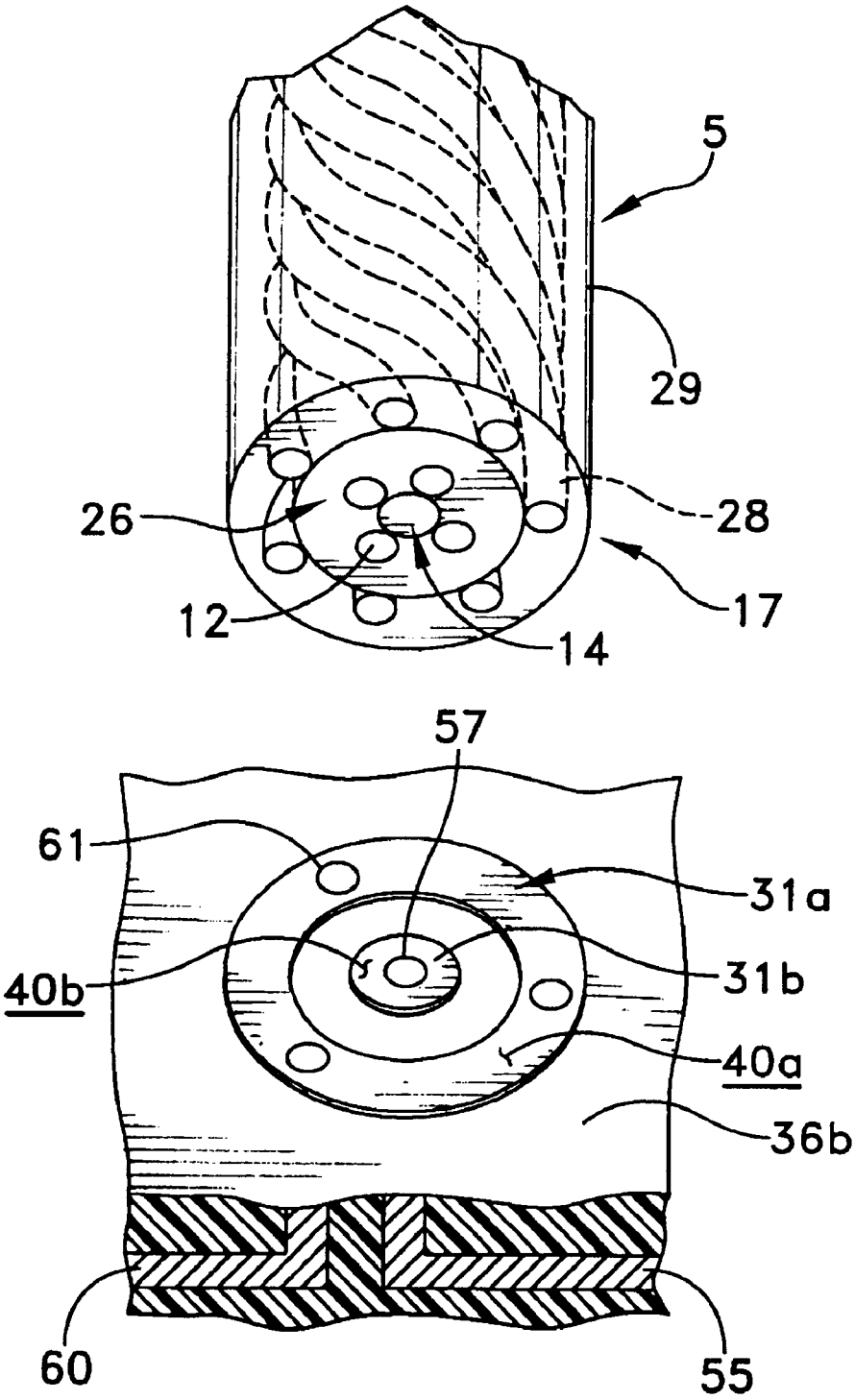
FIG. 12 is a perspective view, partially broken away of a contact formed in accordance with the present invention arranged just prior to engagement with a contact pad positioned on a portion of a printed wiring board.
Figure 15:
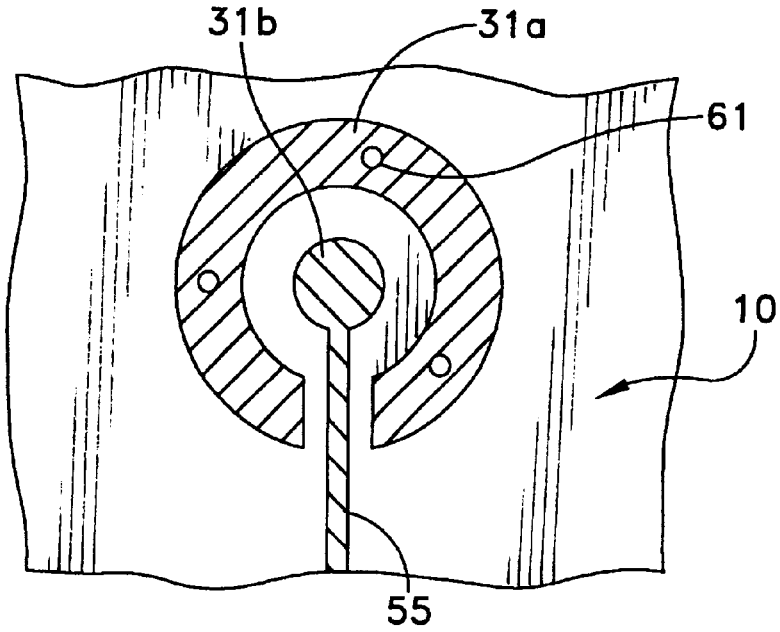
FIG. 15 is a front elevational view of a contact pad having a surface trace formed on a flex circuit.
Figure 16:
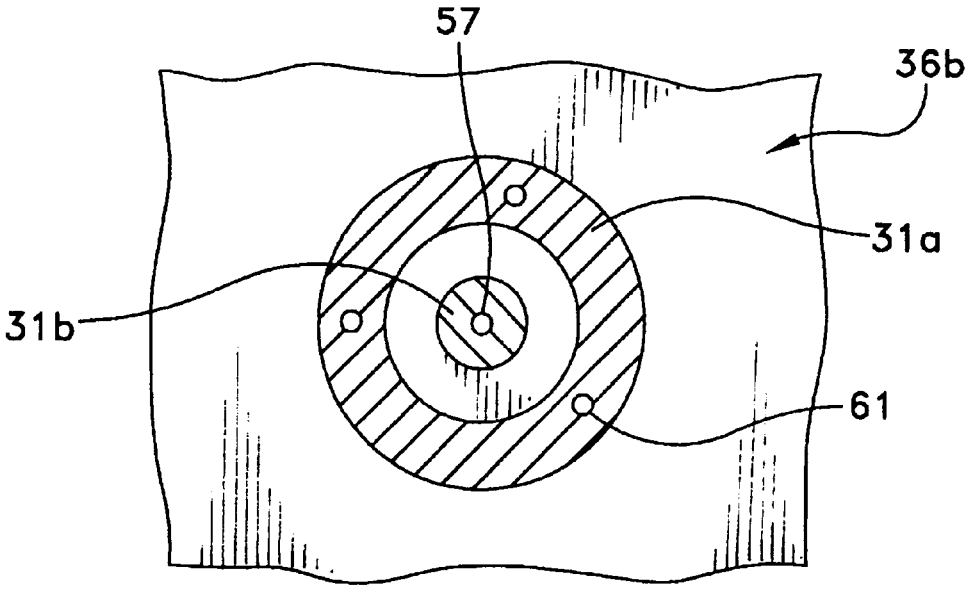
FIG. 16 is a front elevational view of an alternate contact pad having a signal trace exiting through a printed wiring board.
Figure 19:
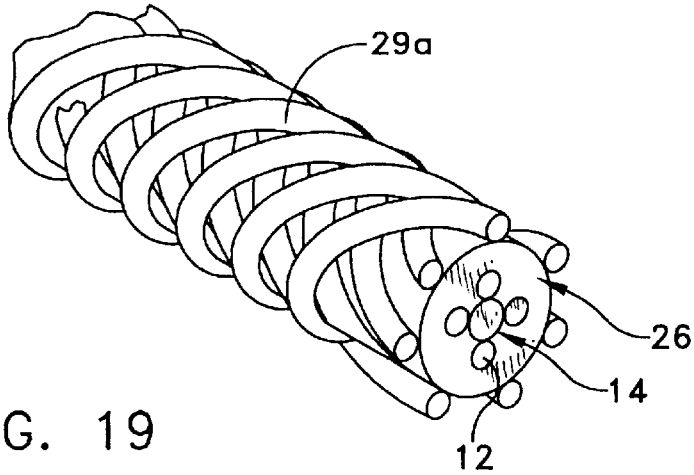
FIG. 19 is a perspective view of an alternative shielding layer having a plurality of wires, with each wire being wound in a spiral having a direction of wind, and where the direction of wind of at least one of the wires is an opposite direction to the direction of wind of at least one of the other wires.
Figure 20:
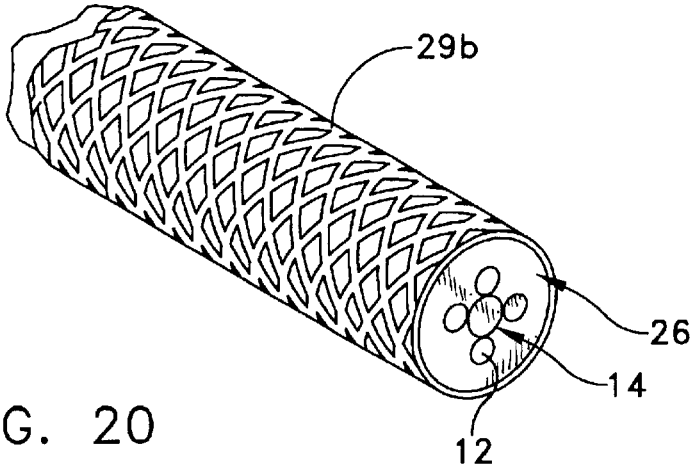
FIG. 20 is a perspective view of an alternative shielding layer comprising a conductive wire mesh.
Figure 21:
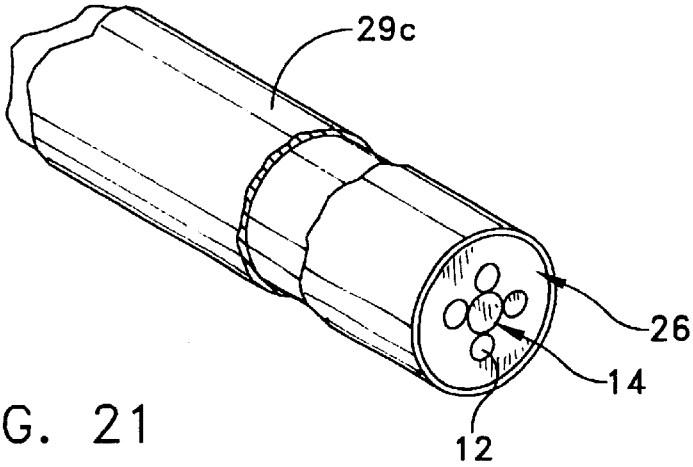
FIG. 21 is a perspective view of an alternative shielding layer comprising a continuous metallic layer.

Contacts 5 are preferably shielded with at least one electrically conductive shielding layer 28 made of individual conductors, wire mesh or, alternatively, a continuous metallic layer, that is arranged in surrounding relation to compressible outer shell 26 and insulating core 14 that is positioned over the inner lying flexible conducting elements 12 (FIGS. 3, and 8–11). This arrangement is analogous to a coaxial cables conductor where the central conductor is surrounded by one or more outer conductive shield layers. Shielding layer 28 is often protected by one or more additional dielectric and/or shielding layers 29. In addition, a variety of arrangements of shielding layer may be employed with the present invention (FIG. 11). For example, one shielding layer 29*a* includes a plurality of wires, with each wire being wound in a spiral having a direction of wind, and where the direction of wind of at least one of the wires is an opposite direction to the direction of wind of at least one of the other wires (FIG. 19). Also, a shielding layer 29 may comprise a conductive wire mesh 29*b* (FIG. 20) or a continuous metallic layer 29*c* (FIG. 21). Of course, it will be understood that is each embodiment of the invention, an insulating layer surrounds the shielding layer.

Contacts 5 can be manufactured by first making a cable-like structure, via an extrusion process, and then cutting the cable-like structure into preselected length pieces. Contacts 5 may also be made by other conventional methods, such as injection molding.

The rigidity of flexible conducting element 12 is selected so that when contact 5 is compressed (or the compressive force is released) the contacting portions urge an identical or substantially corresponding displacement in both flexible conducting element 12 and compressible outer shell 26, and shielding layers 28, 29. This allows first end 17 and second end 19 of contact 5 to establish and maintain electrical and mechanical contact with between contact pads 31*a*,31*b* that are located in a corresponding array of contact pads on printed wiring boards 36*a*,36*b*, respectively, by means of the electrical conductors running through contact 5.

It will be understood that changing the shape, number, and rigidity of flexible conducting elements 12, as well as, the shape and rigidity of the compressible insulating core 14, outer shell 26, shielding layer 28 or 29, the contact resistance, contact force, and compressibility can be selected within a wide range. Also, flexible conducting elements 12 are completely embedded in, and may be supported by, compressible outer shell 26 and shielding layers 28, 29 since they are too fine and flexible to stand on their own. Alternatively, flexible conducting elements 12 may contribute significantly to the mechanical stability of contact 5. The overall cumulative contact force of contacts 5 against the contact surfaces 40*a*, 40*b* of contact pads 31*a*,31*b* is low due to the resilient construction and compressibility of contacts 5, and is preferably in the range of approximately 20 to 40 grams per contact.

Additionally, contacts 5 establish and maintain contact between each flexible conducting element 12 and its corresponding contact pads 31*a*,31*b* at a high localized contact force, sufficient to induce plastic yielding. Another factor in producing a low overall contact force is limiting the number of continuous flexible conducting elements 12 per unit surface area or volume of contact body. The number and conductivity, however, of flexible conducting elements 12 should be selected so as to produce a low total resistance, at a preselected characteristic impedance, for the connector system, preferably in the range of 10 milliohms or less per contact 5. It will also be understood that the angle of each flexible conducting element 12 at the surface of flat surface of contact 5, which is determined in the case of a winding or coil by the pitch, is a design parameter that bears a direct relation to the contact pressure required—the steeper (more vertical) the angle, the higher the force required.

Referring to FIGS. 2 and 13, one of the important aspects of the high speed connector system of the present invention is the provision of a flexcircuit board-to-board interconnect system 50 which achieves a relatively high number of high data rate compatible electrical connections in a relatively small area, in a manner which does not substantially reduce or compromise the bandwidth of the signals conducted through the assembly of contacts 5.

In one embodiment of the invention, flexcircuit board-to-board interconnect system 50 comprises a plurality of contacts 5 mechanically and electrically engaged with a plurality of circuit traces 55 located in flexcircuit 10. Each contact 5 is assembled to flexcircuit 10 such that one or more of its flexible conducting elements 12 is electrically connected to each respective trace 55 via contact pad 31*b*, and its shielding layers 28 are electrically connected to a ground plane conductor 60, via contact pad 31*a*. It should be understood that contact pads 31*a*, 31*b* may be arranged so as to allow for a surface exit of trace 55 through a power or signal via 57 (FIGS. 12–16) or ground plane conductor 60 through a ground via 61.

In another embodiment of the invention, a housing block 18 may be employed comprising a variety of support structures that are suitable for arranging and supporting contacts 5. The electrical and mechanical characteristics of connector system 2 may be optimized by careful selection of the material for housing block 18 based on such factors as cost, rigidity, thermal stability, and inertness to humidity and air and chemical impurities. Suitable materials for housing block 18 include polymers having a low and uniform dielectric constant, such as any of the well known dielectric, polymer materials that are suitable for injection molding, and are commonly used in the connector or semiconductor packaging industry, e.g., polyhalo-olefins, polyamides, polyolefins, polystyrenes, polyvinyls, polyacrylates, polymethacrylates, polyesters, polydienes, polyoxides, polyamides and polysulfides and their blends, co-polymers and substituted derivatives thereof.

For example, housing block 18 may comprises a plurality of injection molded shells 75, each having one or more internal receptacle guides 77 that are sized and shaped so as to receive an elongate contact 5. In this way, a board-to-board connector 2 may be formed having a plurality of contacts 5 arranged so as to provide for either ninety degree or parallel positioning of the mated printed wiring boards.

Alternatively, contacts 5 may be insert molded during the formation of housing block 18 to form a board-to-board connector 2.

Figure 17:
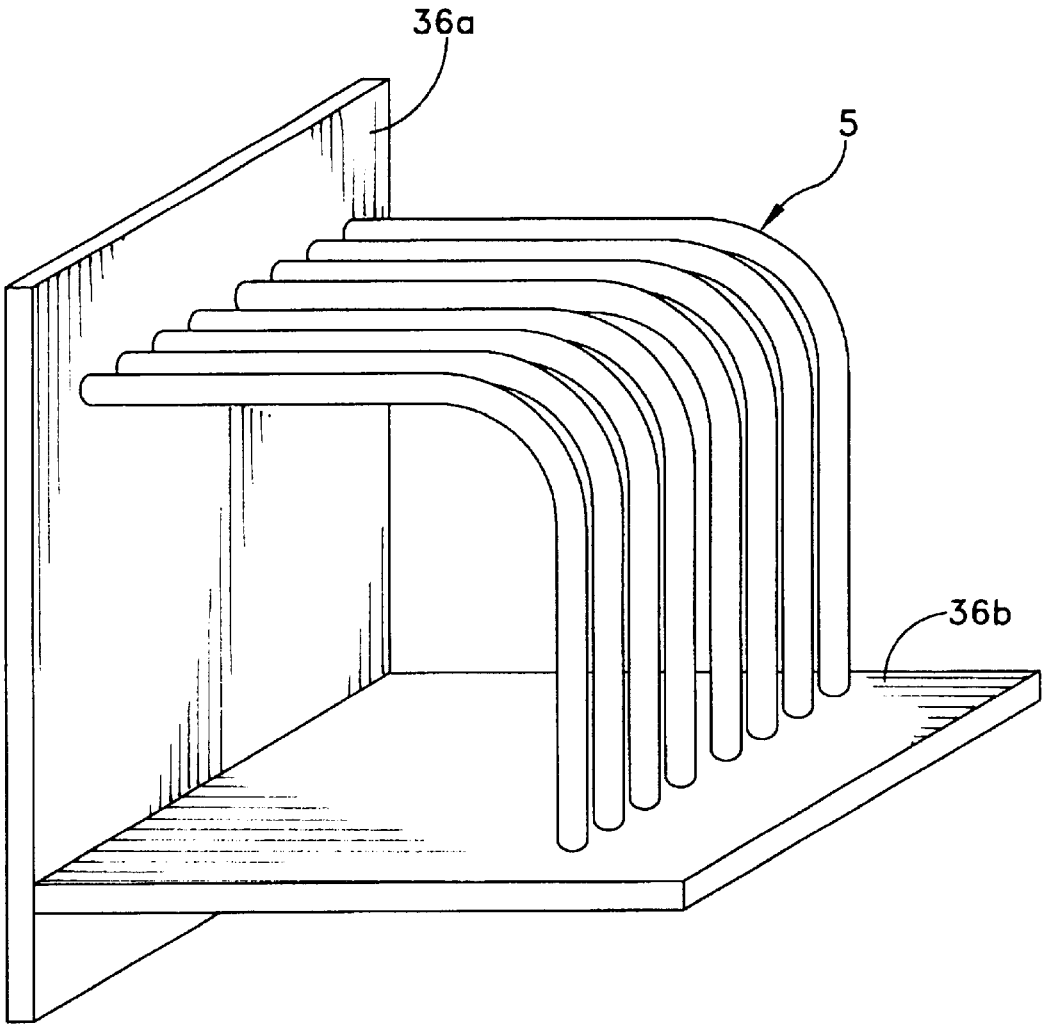
FIG. 17 is a further alternative embodiment of board to board interconnect/jumper system formed in accordance with the present invention.

Referring to FIG. 17, in a further embodiment of the present invention, a plurality of contacts 5 may be used as jumpers between printed wiring boards 36*a*, 36*b*. In this embodiment, a plurality of contact pads 31*a*, 31*b* are arranged in an array on the surfaces of printed wiring boards 36*a* and 36*b*, with first end 17 and second end 19 of each contact 5 electrically and mechanically engaged with a corresponding contact pad 31*a*, 31*b*. It will be understood that conventional soldering or brazing methods may be used to facilitate the mechanical and electrical interconnection between contacts 5 and contact pads 31*a*, 31*b*.

Figure 18:
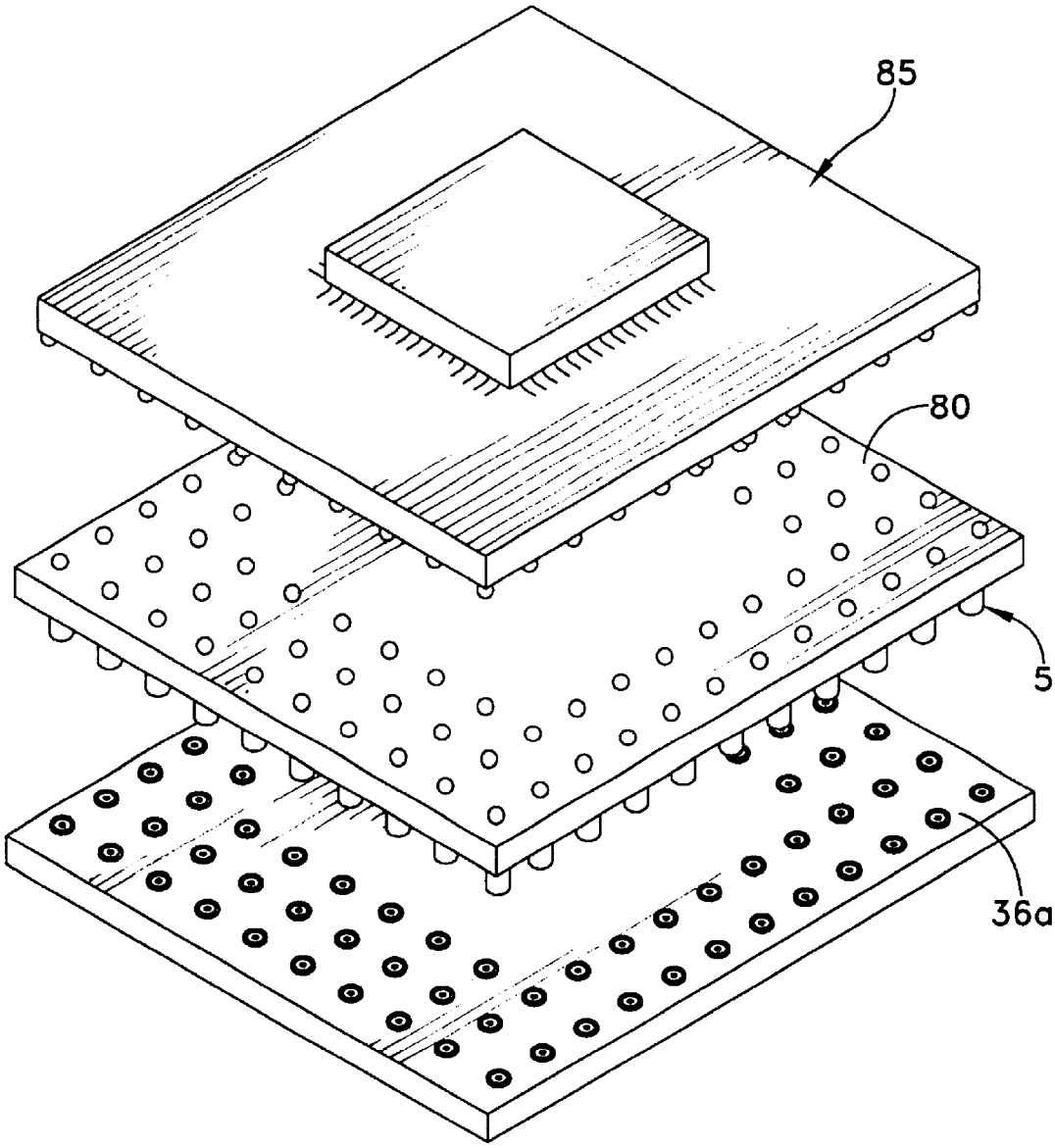
FIG. 18 is a exploded perspective view of an interposer adapted for interconnecting a microprocessor or like semiconductor device to a printed wiring board.

Referring to FIG. 18, an interposer 80 may be formed having a plurality of contacts 5 arranged on one or both surfaces so as to provide an interconnection between a printed wiring board 36*a* and a microprocessor package 85 that is to be arranged on printed wiring board 36*a*.

It is to be understood that the present invention is by no means limited only to the particular constructions herein disclosed and shown in the drawings, but also comprises any modifications or equivalents within the scope of the claims.

What is claimed is:

1. A flex circuit board-to-board connector system comprising:

a flex circuit having a plurality of signal conductor traces and a plurality of ground path conductors; and a plurality of contacts arranged in an array on an outer surface of said flex circuit; each of said plurality of contacts including:

a resilient body having a first end and a second end and including;

a first conductor comprising at least one wire formed in a spiral around a central resiliently compressible insulating core extending continuously through said resilient body from said first end to said second end, said at least one wire including electrically accessible first and second ends wherein said first conductor is electrically connected to at least one of said plurality of signal conductor traces; and a second conductor comprising at least one second wire formed in a spiral around a resiliently compressible insulating shell surrounding said first conductor and extending continuously in substantially coextensive relation to said central resiliently compressible insulating core to thereby form said resilient body, said second conductor having electrically accessible first and second ends, and wherein said second conductor is electrically connected to at least one of said plurality of ground path conductors.

2. A flex circuit board-to-board connector system according to claim 1 wherein said contacts include the resilient body having a first end and a second end and a length therebetween; and said first conductor comprises a thin wire extending from said first end to said second end so as to be electrically engagable such that when said first end of said contact engages a first conductive pad, and said second end of said contact engages a second conductive pad, said thin wire forms an electrically conductive path through said contact from said first conductive pad to said second conductive pad.

3. A flex circuit board-to-board connector system according to claim 1 wherein said resilient body is formed of an elastomer.

4. A flex circuit board-to-board connector system according to claim 3 wherein said elastomer is selected from a group consisting of silicon rubber, neoprene or polybutadiene.

5. A flex circuit board-to-board connector system according to claim 1 wherein said contact is made of a material selected from a group consisting of gold, copper and metal alloys.

6. A flex circuit board-to-board connector system according to claim 1 wherein there are a plurality of wires, each wire being wound in a spiral having a direction of wind, and the direction of wind of at least one of the wires is in an opposite direction to the direction of wind of at least one of the other wires.

7. A flex circuit board-to-board connector system according to claim 1 wherein said second conductor forms an electrical shielding layer.

8. A flex circuit board-to-board connector system according to claim 7 wherein said electrical shielding layer is a conductive wire mesh.

9. A flex circuit board-to-board connector system according to claim 7 wherein said electrical shielding layer is a continuous metallic layer.

10. A flex circuit board-to-board connector system according to claim 7 further comprising an insulating layer surrounding said shielding layer.

11. A flex circuit board-to-board connector system according to claim 7 wherein said shielding layer is arranged so as to surround substantially all of the length of a resilient outer shell arranged around said second conductor.

12. A board-to-board connector system comprising:

a plurality of housing shells each including at least one contact receptacle guide and assembled so as to form a contact housing; and a plurality of contacts each arranged in one of said at least one contact receptacle guides so as to form an array of mateable contact ends that project outwardly from at least two surfaces of said contact housing; wherein each of said plurality of contacts includes:

a resilient body having a first end and a second end and including;

a first conductor comprising at least one wire formed in a spiral around a central resiliently compressible insulating core extending continuously through said resilient body from said first end to said second end, said at least one wire including electrically accessible first and second ends wherein said first conductor is electrically connected to at least one of said plurality of signal conductor traces; and a second conductor comprising at least one second wire formed in a spiral around a resiliently compressible insulating shell surrounding said first conductor and extending continuously in substantially coextensive relation to said central resiliently compressible insulating core to thereby form said resilient body, said second conductor having electrically accessible first and second ends, and wherein said second conductor is electrically connected to at least one of said plurality of ground path conductors.

13. A board-to-board connector system according to claim 12 wherein said contacts include the resilient body having a first end and a second end and a length therebetween; and said first conductor comprises a thin wire extending from said first end to said second end so as to be electrically engagable such that when said first end of said contact engages a first conductive pad, and said second end of said contact engages a second conductive pad, said thin wire forms an electrically conductive path through said contact from said first conductive pad to said second conductive pad.

14. A board-to-board connector system according to claim 12 wherein said resilient body is formed of an elastomer.

15. A board-to-board connector system according to claim 12 wherein said elastomer is selected from a group consisting of silicon rubber, neoprene or polybutadiene.

16. A board-to-board connector system according to claim 12 wherein said contact is made of a material selected from a group consisting of gold, copper and metal alloys.

17. A board-to-board connector system according to claim 12 wherein there are a plurality of wires, each wire being wound in a spiral having a direction of wind, and the direction of wind of at least one of the wires is in an opposite direction to the direction of wind of at least one of the other wires.

18. A board-to-board connector system according to claim 12 wherein said second conductor forms an electrical shielding layer.

19. A board-to-board connector system according to claim 18 wherein said electrical shielding layer is a conductive wire mesh.

20. A board-to-board connector system according to claim 18 wherein said electrical shielding layer is a continuous metallic layer.

21. A board-to-board connector system according to claim 18 further comprising an insulating layer surrounding said shielding layer.

22. Aboard-to-Aboard connector system according to claim 18 wherein said shielding layer is arranged so as to surround substantally all of the length of a resilient outer shell arranged around said second conductor.

23. A board-to-board interconnection system comprising:

a plurality of resilient contacts arranged between a first and a second printed wiring board so as to form an array of mateable contact ends that engage a plurality of contact pads that are arranged in a corresponding array, wherein each of said plurality of contacts includes:

a resilient body having a first end and a second end and including;

a first conductor comprising at least one wire formed in a spiral around a central resiliently compressible insulating core extending continuously through said resilient body from said first end to said second end, said at least one wire including electrically accessible first and second ends wherein said first conductor is electrically connected to at least one of said plurality of signal conductor traces; and a second conductor comprising at least one second wire formed in a spiral around a resiliently compressible insulating shell surrounding said first conductor and extending continuously in substantially coextensive relation to said central resiliently compressible insulating core to thereby form said resilient body, said second conductor having electrically accessible first and second ends.

24. A board-to-board interconnection system according to claim 23 wherein said contacts include the resilient body having a first end and a second end and a length therebetween; and said first conductor comprises a thin wire extending from said first end to said second end so as to be electrically engagable such that when said first end of said contact engages a first conductive pad, and said second end of said contact engages a second conductive pad, said thin wire forms an electrically conductive path through said contact from said first conductive pad to said second conductive pad.

25. A board-to-board interconnection system according to claim 23 wherein said resilient body is formed of an elastomer.

26. A board-to-board interconnection system according to claim 23 wherein said elastomer is selected from a group consisting of silicon rubber, neoprene or polybutadiene.

27. A board-to-board interconnection system according to claim 23 wherein said contact is made of a material selected from a group consisting of gold, copper and metal alloys.

28. A board-to-board interconnection system according to claim 23 wherein there are a plurality of wires, each wire being wound in a spiral having a direction of wind, and the direction of wind of at least one of the wires is in an opposite direction to the direction of wind of at least one of the other wires.

29. A board-to-board interconnection system according to claim 23 wherein said second conductor forms an electrical shielding layer.

30. A board-to-board interconnection system according to claim 29 wherein said electrical shielding layer is a conductive wire mesh.

31. A board-to-board interconnection system according to claim 29 wherein said electrical shielding layer is a continuous metallic layer.

32. A board-to-board interconnection system according to claim 29 further comprising an insulating layer surrounding said shielding layer.

33. A board-to-board interconnection system according to claim 29 wherein said shielding layer is arranged so as to surround substantially all of the length of a resilient outer shell arranged around said second conductor.

34. An interposer for providing conduction between a first and a second array of contact pads at a predetermined contact force, the interposer comprising:

a dielectric grid having an array of holes therethrough; and a plurality of contacts each including:

a resilient body having a first end and a second end and including;

a first conductor comprising at least one wire formed in a spiral around a central resiliently compressible insulating core extending continuously through said resilient body from said first end to said second end, said at least one wire including electrically accessible first and second ends wherein said first conductor is electrically connected to at least one of said plurality of signal conductor traces; and a second conductor comprising at least one second wire formed in a spiral around a resiliently compressible insulating shell surrounding said first conductor and extending continuously in substantially coextensive relation to said central resiliently compressible insulating core to thereby form said resilient body, said second conductor having electrically accessible first and second ends, wherein;

said plurality of contacts are arranged in said array of holes in said dielectric grid such that when said interposer is placed between said first and second array of contact pads, the said first end of said contacts engages one contact pad in said first array of contact pads, and said second end engages a second contact pad in said second array of contact pads.

* * * * *

UNITED STATES PATENT AND TRADEMARK OFFICE

CERTIFICATE OF CORRECTION

PATENT NO. : 6,712,620 B1
DATED : March 30, 2004
INVENTOR(S) : Che-Yu Li et al.

It is certified that error appears in the above-identified patent and that said Letters Patent is hereby corrected as shown below:

Column 9,
Line 27, change "Aboard-to-Aboard" to -- A board-to-board --

Signed and Sealed this

Twentieth Day of July, 2004

JON W. DUDAS
*Acting Director of the United States Patent and Trademark Office*